US005142338A

United States Patent [19]

Malinaric et al.

[11] Patent Number: 5,142,338

[45] Date of Patent: Aug. 25, 1992

[54] TRANSFER WEB TENSIONING SYSTEM FOR AN ELECTROSTATIC TRANSFER APPARATUS

[75] Inventors: Paul J. Malinaric, Groton, Mass.; David P. Bujese, Southington, Conn.

[73] Assignee: Olin Corporation, Cheshire, Conn.

[21] Appl. No.: 681,282

[22] Filed: Apr. 8, 1991

[51] Int. Cl.[5] ..... G03G 15/14

[52] U.S. Cl. ..... 355/271; 355/212; 355/281

[58] Field of Search ..... 355/271, 281, 212, 274, 355/275, 276, 279; 242/67.4, 75.5

[56] References Cited

U.S. PATENT DOCUMENTS

| | | | |
|---|---|---|---|
| 3,617,124 | 11/1971 | Haugen et al. | 355/212 |
| 3,630,615 | 12/1971 | Raynard | 355/271 |
| 4,444,363 | 4/1984 | Jacquel et al. | 242/67.4 |
| 4,527,686 | 7/1985 | Satoh | 355/212 X |
| 4,752,800 | 6/1988 | Matui | 355/212 |
| 4,869,707 | 9/1989 | in't Zandt et al. | 474/115 |
| 4,894,686 | 1/1990 | Bujese | 355/271 |
| 4,921,772 | 5/1990 | Bujese | 355/274 X |

OTHER PUBLICATIONS

USSN 07/459,881 filed Jan. 2, 1990 by David P. Bujese for "Improvements In Electrostatic Transfer Device".

*Primary Examiner*—A. T. Grimley
*Assistant Examiner*—Shuk Y. Lee
*Attorney, Agent, or Firm*—Ralph D'Alessandro

[57] ABSTRACT

A cable tensioning system for use in an electrostatic transfer apparatus is provided to permit a developed image to be transferred from a first surface to a second receiving surface so that the dimensional integrity of the transferred image is ensured. The cable tensioning system is connected to a web or belt material that receives the transferred image as an intermediate transfer surface by a transfer roller traversing the length of the web bringing one surface of the web into close proximity with the developed image to permit it to be transferred to the web. The tensioning system prevents the web from becoming slack.

19 Claims, 2 Drawing Sheets

TRANSFER WEB TENSIONING SYSTEM FOR AN ELECTROSTATIC TRANSFER APPARATUS

BACKGROUND OF THE INVENTION

This invention relates generally to apparatus for the electrostatic transfer of a developed image from a first surface to a second receiving surface. More specifically, it relates to the cable tensioning system that works cooperatively with a web on which the developed image is found to insure the dimensional integrity of the transferred image.

Photoelectrophoretic copying machines have used webs that have been either continuous or of finite length stretched between two locations to produce copies of transferred developed images. Early systems utilized an intermediate web in an electrographic copying machine to produce copies by employing a cartridge formed of two molded shells that contained a supply of intermediate web wound between two rollers. The cartridge was removably mounted on a movable carriage to move between exposing, developing, and transferring stations.

Other early copy equipment used a system to transfer images on a support web to a xerographic belt by matching the speed of the transport belt with the xerographic belt to avoid blurring the transferred toner images.

These prior art systems were all affected by the relative speeds of the belts between which the transferred toner images moved, the amount of tension maintained on the belts by guide rollers to insure uniform tension, and any disturbing impacts or vibrations in the belt during movement about the guide rollers from one position to another as the images were transferred. Little concern was given to the potential for distortion of the full-sized image in the transfer from one belt to another belt or to an intermediate surface. This distortion is caused by slack in the belt and differences in the length of the web from an anchoring point on the copy apparatus to each discrete point of image transfer when the transfer is effected by some movable transfer means bringing the transferring and receiving surfaces into close proximity or contact as the transfer means traverses the length of the web or belt.

These problems are solved in the design of the Present invention by the use of an improved tensioning system for a web or belt in an electrostatic transfer system that employs a tensioning cable in conjunction with the web. The tensioning cable is connected to that web on one end and anchored to the transfer apparatus on an opposing second end.

SUMMARY OF THE INVENTION

It is an object of the present invention to provide an apparatus that transfers a true full-sized image from the toned surface to the receiving belt surface without any image distortion and by preserving the dimensional integrity of the transferred image.

It is another object of the present invention to Provide a cable tensioning system that may be repeatedly used in full color or two sided imaging because of the achievement of perfect registration and alignment of superimposed images from one transfer to the next.

It is a feature of the present invention that a tensioning cable is fastened on one end to the transfer apparatus and connected to the transfer web or belt on an opposing end which is connected to the transfer apparatus so that the web or belt is maintained in tension during operation.

It is another feature of the present invention that the tensioning cable is aligned along the center line of the web or belt so that the image length is not changed during image transfer and the tensioning cable is in the same horizontal plane as the transfer means used to effect the transfer of the developed image at discrete points along the belt or web's surface.

It is another feature of the present invention that the web or belt may be a heated intermediate transfer surface to permit transfer of a developed image from a master to the intermediate surface and then to a final receiving surface.

It is still another feature of the present invention that the belt or web has a tensioning cable cooperative with the web or belt on along both lateral edges.

It is still another feature of the present invention that the sum of the distances from the first point where the web and the tensioning cable are connected to the transfer roller and from the transfer roller to the second point where the tensioning cable is attached to the frame is always the same at each discrete transfer point as the transfer means traverses the web during transfer of a toned image to the web from a master or first surface.

It is an advantage of the present invention that full-sized images are transferred from the developed image surface to the receiving surface.

It is another advantage of the present invention that slack is prevented from occurring in the intermediate transfer web and the dimensional integrity of the transferred image is not affected during transfer.

These and other objects, features and advantages are obtained in the apparatus of the present invention that employs a web tensioning system for an electrostatic transfer apparatus with a developed image on a web or belt and transfer means which traverse the web or belt to transfer the developed image to a receiving surface. The web tensioning system employs a tensioning cable that is connected to the web on one end and is always coplanar in the same horizontal plane as the web at the location of the transfer means at each discrete transfer point along the length of the web.

BRIEF DESCRIPTION OF THE DRAWINGS

The objects, features and advantages of the present invention will become apparent upon consideration of the following detailed disclosure of the invention, especially when it is taken in conjunction with the accompanying drawings wherein.

DETAILED DESCRIPTION OF THE PREFERRED EMBODIMENTS

Figure 1:
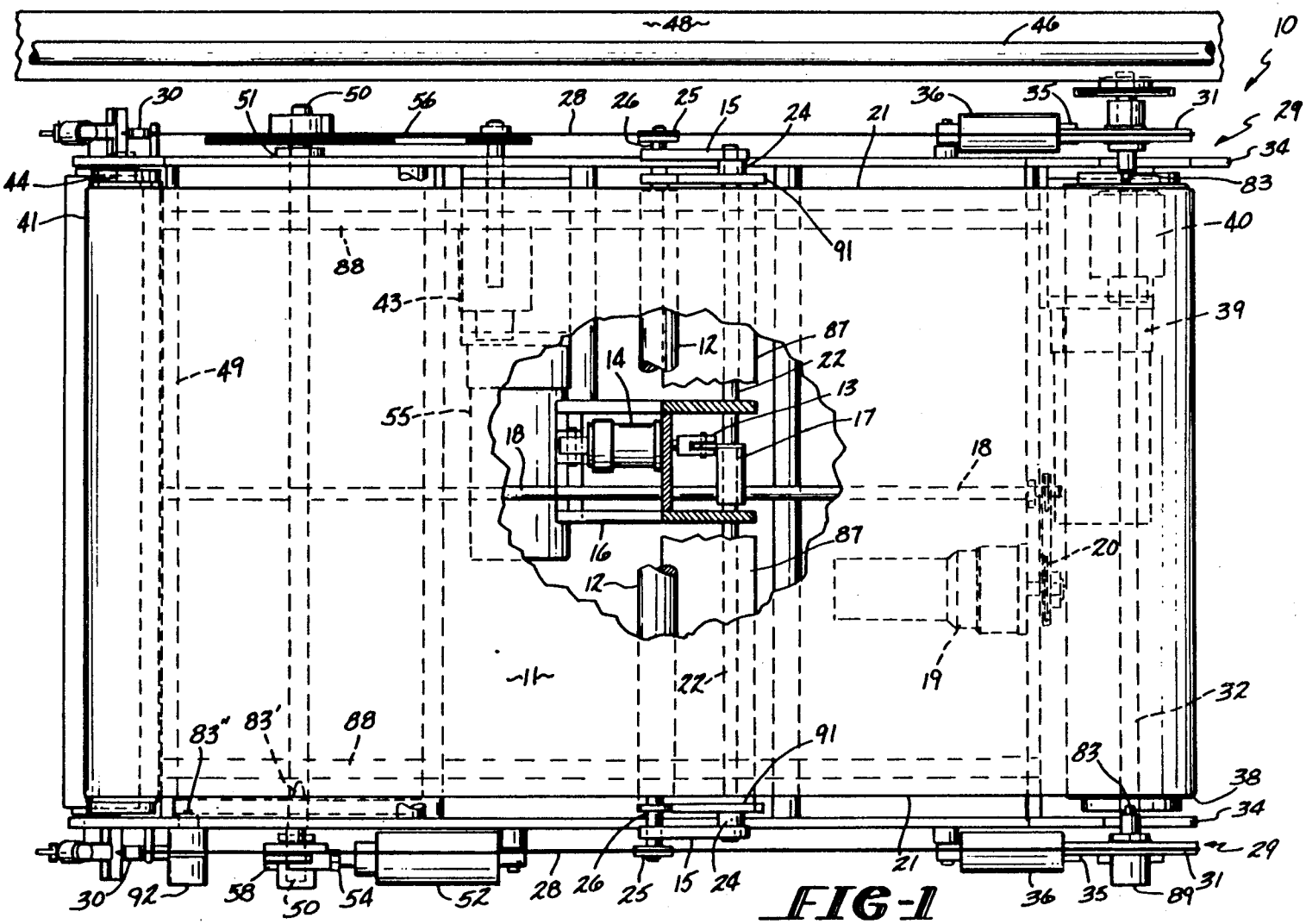
FIG. 1 is a top plan view of the web with a portion of the web cut away showing the relationship of the tensioning cable and the web along both lateral sides of the web.

FIG. 1 shows in top plan view a web 11 mounted to electrostatic transfer apparatus, which is partially shown and is indicated generally by the numeral 10. The electrostatic transfer apparatus 10 is generally of the type described in U.S. Pat. No. 4,921,772 assigned to the assignee of the present invention, and herein after specifically incorporated by reference in pertinent part. In the apparatus displayed in FIGS. 1 and 2 the transfer roller means 12 is effective to raise the web upwardly to bring it into proximity with the toned image which is transferred across a fluid-filled gap to the web 11 essentially as described in the incorporated U.S. Pat. No. 4,921,772.

As seen in FIG. 1, web 11 has a portion broken away to show the underlying transfer roller 12 and air cylinder 14 that is effective to raise the transfer roller 12 via transfer roller arm linkage 15. The transfer roller air cylinder 14 is attached to a bracket 16 which in turn is attached to the under side or web backing plate 87. The web backing plate 87 and the transfer roller 12 are driven as a unit from right to left in FIG. 2 with the transfer roller in a down position to allow the web surface to be wicked with a nonpolar insulating solvent sold under the tradename ISOPAR by Exxon Corporation by a wicking apparatus (not shown) but described and shown in detail in copending patent application Ser. No. 07/459,881 hereinafter specifically incorporated by reference in pertinent part. The web backing plate 87 supports the web 11 during the wicking operation and ensures an even layer of ISOPAR is dispensed on the surface or the web 11. The web backing plate 87 is supported on both ends by linear bearing guide shafts 88.

The web backing plate 87, the transfer roller 12 and air cylinder 14 are all reversibly driven by a drive screw or drive shaft 18 that is turned by a reversible drive screw motor 19 via appropriate sprocket and chain linkage 20. Reversible drive screw motor 19 permits the transfer roller air cylinder reversible bracket 16, and the web backing Plate 87 to which it is attached, to reversibly traverse the length of the drive screw or shaft 18 along a portion of the length of the web 11 corresponding to the image area. The transfer roller 12 serves to raise the web 11 into close proximity with the toned image that is placed above the web 11 to receive at each discrete point during the electrostatic transfer the developed image onto the top surface of the web 11.

Figure 2:
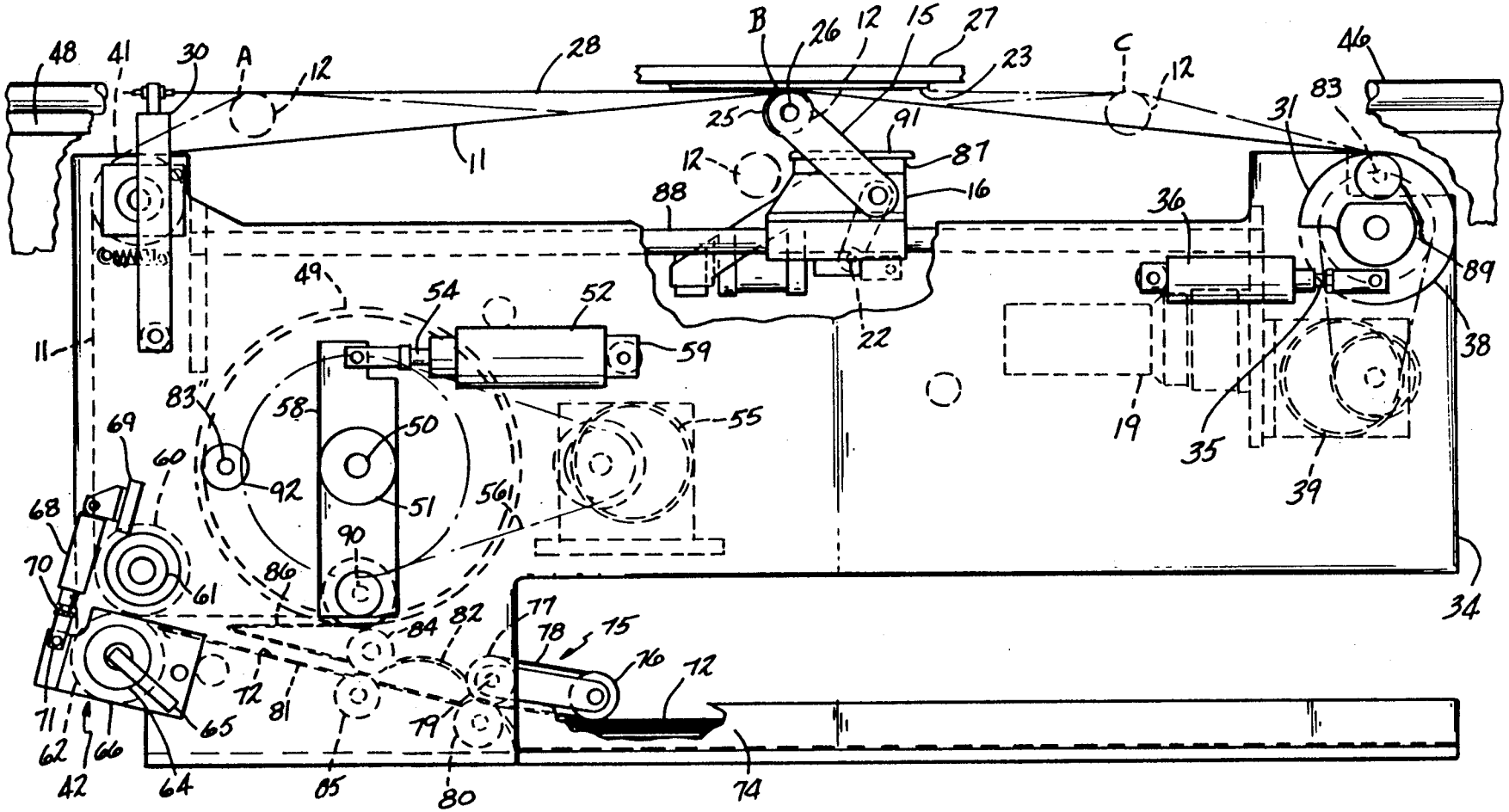
FIG. 2 is a side elevational view of the apparatus employing a tensioning cable and an intermediate web on which a developed image is placed.

The linkage arms 15 of FIGS. 1 and 2 are positioned on opposing sides of the lateral edges 21 of the web 11 and rotate about shaft 22 via bushings 24. The outboard or lateral ends of transfer roller 12 have a rotatable guide pulley 25 mounted about shaft 26 which passes through linkage arms 15.

As is best seen in FIG. 1, rotatable guide pulleys 25, mounted along the same shaft 26 as the transfer roller 12, contact the tensioning cable 28 that is a part of the cable tensioning system or mechanism, indicated generally by the numeral 29. Cable tensioning system 29 has the tensioning cable 28 on each side of the apparatus 10. Cable 28 is connected to the frame of the apparatus by a fixed cable mount 30 on both sides of the apparatus. As best seen in FIG. 2, the fixed cable mounts 30 (only one of which is shown) maintain the tensioning cable 28 via appropriate means, such as retaining locking screws, to the frame sideplates 34 and can be spring biased. Fixed cable mounts 30, in conjunction with the takeup pulleys 31 to establish the highest point at which the web 11 and the transfer roller 12 will be as the transfer roller 12 approaches the limit of its traverse along the drive screw 18.

The multiple positions of the transfer roller 12 as it reversibly traverses the drive screw 18 are shown in phantom lines in FIG. 2. Three representative positions are indicated by the letters A, B and C. The transfer roller 12 is not elevated to the raised position unless the air cylinder 14 has extended the linkage arms 15 upwardly by the rotation of the air cylinder linkage arm shaft 22 and its air cylinder linkage arm shaft sleeves 17 by the extension of the air cylinder piston arm 13, best seen in FIG. 1. Cable tensioning system 29 also includes on the opposing end from the fixed cable mount 30 a rotatable takeup pulley 31 for each tensioning cable 28. Both of the takeup pulleys 31 and the guide pulleys 25 have recessed center portions within which to receive the tensioning cable 28. The recessed portions, not shown, are essentially U-shaped or any other appropriate machined out configuration to receive and retain the cables 28 in positive guidance.

Take up pulleys 31 are rotatably mounted via appropriate bushings to shaft 32 which extends through the frame side plate 34 on both sides of the apparatus 10.

Takeup pulleys 31 are rotatable by the action of the piston arm 35, best seen in FIG. 2, of air cylinders 36 that serve as tensioning air spring mechanisms to ensure sufficient tension is maintained on the tensioning cables 28 at all appropriate times. Tension is removed briefly when the locking pins 83 are retracted. Air cylinders 36 are appropriately mounted to the frame sideplates 34 on both sides of the apparatus 10.

Shaft 32 also has mounted thereabout it drive roller 38 which is rotated by a constantly driven drive motor 39, best seen in FIG. 2. The drive roller 38 is engaged for rotation by the drive motor 39 via an air clutch 40 to selectively permit rotation of the drive roller 38 and the taking up of the web 11 about its periphery. Web 11 is appropriately fastened to drive roller 38, such as by a metallic retaining plate screwed into the periphery of the roller 38 in which a recess has been machined out so that the web 11 sits within the machined portion and beneath the metallic retaining strip (all not shown).

As is best seen in FIG. 1, two air cylinders 89 are connected to the takeup pulleys 31. An air cylinder 52 is attached to the mounting bracket 58. Cylinders 89 and 52 actuate and engage pins 83 and 83', respectively, to prevent any rotation respectively between takeup pulleys 31 and drive roller 38 and drum drive roller 49 and mounting bracket 58. The combined action of air cylinders 36 and 52 assist tensioning the web between drive roller 38 and drum driven roller 49. Tensioning cable 28 via the cable tensioning system 29 retains sufficient tension on the drive roller 38 so that the web 11 is kept taut with no slack during the transfer operation. This tensioning system 29 ensures that there is no image distortion in the transfer of the fully toned image that has been electrostatically transferred to the top surface of the web 11 to the final receiving surface in a transfer that will be described hereafter.

On the end adjacent the fixed cable mount 30 a guide roller 41 best seen in FIG. 1, spans the width of the apparatus 10 and has the web 11 pass thereabout as it is stretched down to the imaged transfer station, indicated generally by the numeral 42 in FIG. 2.

Before drive motors 39 and 55, respectively, can be turned on via air clutches 40 and 43 the drive roller 38 and drum roller 49 must be disengaged from both the cable tensioning system 29 and the web tensioning air cylinder 5, 36 and 52. This is accomplished by disengaging the pins 83 and 83' via air cylinders 89 and 90 of FIG. 2. It should be noted that the tension on drive roller 38 is greater than on drive roller 49 because there is greater air pressure kept on air cylinders 36 than on air cylinder 52. This maintains air cylinders 36 in a "home" position and air cylinder is slightly rotated out of the home position. The counter driving rotational directions of drive motors 39 and 55 of FIG. 2 helps maintain the web 11 in tension even after the locking pins 83 and 83' are retracted.

As is best seen from FIG. 2, as the transfer roller 12 moves from position A to position B, it causes the drive roller 49 to move slightly clockwise, thereby causing the air cylinder arm 54 to retract slightly. As the transfer roller 12 moves from position B to C, it causes the drive roller 38 to move slightly counterclockwise, while drive roller 49 moves clockwise to keep the web 11 in tension. Air cylinder 36, when locked to drive roller 38 via locking pins 83, tensions the cable 28 and the web 11 in the clockwise direction by locking takeup pulleys 31 to drive roller 38. Drive roller 49 tensions only the web 11 in the counterclockwise direction when locked in position by locking pin 83'.

One of two guide rail means 46 are seen in FIG. 1. Guide rail means 46 serve to provide a track along which the toned image supporting platon (not shown) may traverse over the web 11 to facilitate the transfer of the toned image from the platen to the top surface of the web 11 via the proximal positioning achieved by the transfer roller 12 along the length of the web 11. The guide rail means 46 is supported by an L-shaped frame mount 48, appropriately connected to the frame of the apparatus 10.

Also seen in FIG. 1, but best seen in greater detail in FIG. 2, is a drive roller 49 mounted about a shaft 50 and bushing 51. Drive roller 49 is tensioned by an air cylinder 52 which, via its piston arm shaft 54, effectively locks the air cylinder bracket 58 to the drum drive roller 49 via air cylinder 90 as the roller 49 is driven by drive motor 55 of FIG. 2 via a chain and sprocket mechanism 56. Cylinder 52 is secured to drive roller 49 via air cylinder 90 mounted on air cylinder bracket 58, extending locking pin 83' into an appropriate receptacle on roller 49. Bracket 58 pivots about shaft 50. Locking pin 83' locks the drive roller 49 to the air cylinder bracket 58 that is attached to air cylinder 52 to put tension on the web 11 in the counterclockwise direction, as seen in FIG. 2. At the same time locking pins 83 lock the cable system, in conjunction with air cylinder 29, to the drive roller 38, putting tension on the web 11 in the clockwise direction as seen in FIG. 2.

Cylinder 52 is secured on its opposing end 59 by appropriate means, such as screws or rivets, to frame side plate 34.

FIG. 2 shows the image transfer station, indicated generally by the numeral 42, that is positioned adjacent a guide roller 60 which is rotatably mounted about an appropriate shaft and bushing assembly 61. The web 11 passes about the guide roller 61 and is appropriately fastened to drive roller 49, such as by the apparatus previously described with respect to drive roller 38 wherein a metallic retaining plate was employed by being screwed into the periphery of the roller in which a recess has been machined out. The web 11 sits within the machine out portion and beneath the metallic retaining strip (all not shown). Drive roller 49 thereby enables the web 11 to be taken up about its periphery by rotation of the drum. In this manner, the web 11 with the toned image on its top surface is passed between the guide roller 61 and the fuser roller 62. Fuser roller 62 is rotatably mounted about the shaft 64 that is movably retained in position for generally upward and downward movement away from the web 11 by pivot arm 65 and hinge plate 66. Hinge plate 66 is pivotally mounted to frame sideplate 34 by appropriate means. The air cylinder 68 is appropriately anchored to the frame of the apparatus 10 by a mounting plate 69 that controls the pivotal movement of the hinge plate 66 and fuser roller 62 by the extension or retraction of the piston arm 70. Piston arm 70 is appropriately fastened, such as by pin or removable screw 71, to the hinge plate 66. It should be noted, as is best seen in FIG. 1, that there is a cylinder 68 and hinge plate 66 on each side of the apparatus 10. Hence, when the piston arm 70 is retracted, the fuser roller 62 is raised into contact with the web 11 as it moves about guide roller 60. When the piston arm 70 is extended, the fuser roller 62 is out of contact with the web 11.

Transfer occurs at the transfer station 42 by the feeding of individual paper sheets 72 from the paper feed tray 74 by the feed roller mechanism, indicated generally by the numeral 75. Feed roller mechanism 75 includes a powered roller 76 driven by an appropriate belt or chain driven drive system 78 that is pivotally mounted about the shaft 79 to feed the individual paper sheets 72 upwardly over guide roller 80 onto metal guide tray 81. An upper metal guide leaf 82 prevents the paper from riding up between feed roller 77 and guide roller 84. Upwardly guide rollers 84 and 85 there is an angled upper guide shield 86 that keeps the paper sheets 72 from moving up into contact with the belt and being wound about the drive roller 49. Thus conveyed upwardly by the feed roller mechanism 75, the individual sheets of paper pass along the metal guide tray 81 and between the guide roller 60 and the fuser roller 62. Upon passing through the image transfer station 42, the paper passes into a receiving tray (not shown) having had the image transferred by contact transfer and heating of the fusing roller 62 by appropriate means.

SEQUENCE OF OPERATION

In operation, air cylinders 89 and 90 extend locking pins 83 and 83' to engage take-up pulleys 31 to drive roller 38 and air cylinder mounting bracket 58 to drive roller 49, respectively. Air pressure is supplied by an appropriate compressed air system to air cylinder 36 and is activated to retract piston arm shaft 35 and put tension in a clockwise direction on both drive roller 38 to which web 11 is attached and tensioning cable 28. Simultaneously, air pressure is supplied to air cylinder 52 to extend air cylinder piston arm shaft 54 in a counterclockwise direction to put tension on drive roller 49, to which web 11 is attached. Therefore, the web is held taut between drive rollers 38 and 49.

As the toned image to be electrostatically transferred to web 11 approaches the web 11, the wicking unit (not shown) is driven with and above the web backing plate 87 as both travel from right to left in FIG. 2. A thin layer of ISOPAR solvent is dispensed on the surface of web 11 by the wicking unit. The height of the ISOPAR solvent layer is determined by the distance of the wicking roller (not shown) from the surface of web 11. This distance is adjustable by means of wicking roller gap guides (not shown) which are located on either side of web 11 in FIG. 1. The wicking roller rests on top of the wicking roller gap guides during the wicking operation.

After the surface of web 11 has been coated with an even layer of ISOPAR solvent and a toned image positioned above web 11, transfer roller air cylinder 14 actuates transfer roller 12 in an upward direction to engage a platen (not shown) on which is retained the toned image to be transferred to web 11. The transfer roller 12 is driven from left to right in FIG. 2 by the reversible drive screw motor 19 and drive screw 18. The tensioning cable 28 and the transfer roller 12 are kept in the same horizontal plane at the point of image transfer as the transfer roller moves across the web 11 by the tensioning system 29. Simultaneously, a high voltage is applied to the conductive layer of web 11 to transfer the toned image from the platen to the web 11 through liquid-filled gap of ISOPAR solvent. Upon completion of travel from left to right, the transfer roller 12 is lowered by air cylinder 14 to complete the transfer cycle.

Upon completion of the transfer cycle, excess ISOPAR solvent on the transferred toned image on web 11 can be removed by suitable means, such as an air knife attached to the wicking unit as the wicking unit travels from left to right.

The transferred toned image on web 11 is then scrolled about drive roller 49 after the following occurs. The cable take-up pulleys 31 and associated tensioning cable 28 are disengaged from drive roller 38 by the retraction of pins 83. Simultaneously, air clutch 40 is turned on to maintain tension on web 11 in a clockwise direction as viewed in FIG. 2 by driving drive roller 38 to which web 11 is attached. Locking pins 83 are retracted by air cylinders 89 when tension to cable take-up pulleys 31 is relieved by extending piston arm 35 on air cylinders 36. At the same time the tension on drive roller 49 provided by air cylinder 52 is removed by retracting piston arm shaft 54 and disengaging pivot arm 51 from drive roller 49 by retracting locking pin 83' that is attached to air cylinder 90.

Simultaneously, air clutch 43 is turned on and reversible drive motor 55 drives drive roller 49 in a counterclockwise rotation as viewed in FIG. 2 to maintain tension on web 11. Since a higher air pressure is applied to air clutch 43 than to air clutch 40, air clutch 40 operates in a slip condition and drive roller 38 slips in a counterclockwise direction as viewed in FIG. 2 when drive roller 49 is driven in a counterclockwise rotation. This slip condition on drive roller 38 maintains tension on web 11 as it is driven from right to left in FIG. 2 and scrolled about drive roller 49 and unscrolled from about drive roller 38.

When the trailing edge of the toned image on web 11 passes a short distance beyond fuser roller 62 and the toned image is scrolled about drive roller 49, air cylinder 92 attached to frame side plate 34 extends locking pin 83" into drive roller 49 to lock drive roller 49 to frame side plate 34 to prevent drive roller 49 from rotating in a counterclockwise direction.

After the toned image is scrolled about drive roller 49, a paper sheet 72 from paper feed tray 74 is fed to nip formed by guide rollers 84 and 85 by feed roller mechanism 75 which consists of feed rollers 76 and 77 and guide roller 80. Then reversible drive motor 55 is driven in a clockwise direction as viewed in FIG. 2 to drive drive roller 49 in a clockwise direction via chain and sprocket drive 56. Both of the drive roller 38 and 49 are then driven in a clockwise direction, but the surface speed of drive roller 38 is driven at a higher speed than the surface speed of drive roller 49 to thereby maintain tension on web 11.

Fuser roller 66, which is constantly maintained at the appropriate temperature to fuse the toned image to a receiving substrate such as paper, is activated against the surface of web 11. Web 11 is supported by guide roller 41 at this point of contact. As web 11 is driven in a clockwise direction and scrolled about drive roller 38, guide rollers 84 and 85 are driven to feed the paper sheet 72 in register with the toned image on web 11 into the nip formed between fuser roller 62 and guide roller 41. This fuses the toned image to paper sheet 72 by heat and pressure. Since web 11 is coated with a material which releases the toner to a substrate under heat and pressure, 100 percent of the toned image is transferred to paper sheet 72.

After the toned image is transferred to paper sheet 72, fuser roller 62 is actuated away from web 11 by air cylinder 68 and webb 11 continues to be driven in a clockwise direction until the portion of the belt that was initially imaged returns to its initial or start position. Upon reaching this position air cylinder 92 extends locking pin 83" into drive roller 49 to lock drive roller 49 to frame side plate 34.

Simultaneously thereafter all clutches 40 and 43 are turned off to disengage drive motors 39 and 55 from drive rollers 38 and 49, respectively. Air cylinders 89 extend locking pins 83 into drive roller 38 to lock the take-up pulleys 31 and tensioning cables 29 to drive roller 38. Air cylinder 90 extends locking pin 83' into drive roller 49 to lock pivot arm 51 to drive roller 49. Then air cylinder 92 retracts locking pin 83" to disengage drive roller 49 from frame sideplate 34. The air cylinder 36 retracts piston arm 35 and air cylinder 52 extends piston arm shaft 54 to place web 11 in a taut condition.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

Having thus described the invention, what is claimed is:

1. Apparatus in an image transfer device for tensioning a web to preserve dimensional integrity in a transferred image that is transferred from the web to a final receiving surface, comprising in combination:

(a) a web adapted to receive a toned image, the web extending between a first point and a second point on the image transfer device, the web further having two opposing lateral sides;

(b) transfer means movable along the web between the first point and the second point to transfer a toned image from a first surface to the web or from the web to the receiving surface; and (c) a tensioning cable corresponding with each lateral side and connected on one end to the web at the first point and connected to the image transfer device at an opposing second end, each tensioning cable being cooperative with the transfer means and in the same horizontal plane as the transfer means while the transfer means moves between the first point and the second point during transfer effective to tension the web and preserve the dimensional integrity of the transferred image.

2. The apparatus according to claim 1 wherein the tensioning cables and the web at the first point are connected to a rotatable roller connected to the apparatus.

3. The apparatus according to claim 1 wherein the web is an intermediate transfer surface.

4. The apparatus according to claim 3 wherein each cable further is rotatably fastened at the first point to the image transfer device along each lateral side of the web.

5. The apparatus according to claim 4 wherein the web has a first image receiving surface and an opposing second surface, the transfer means traversing the opposing second surface during image transfer.

6. The apparatus according to claim 5 wherein the web is fastened at the first point to a first rotatable drum, the rotatable drum keeping the web in tension to take up any slack in the web.

7. The apparatus according to claim 6 wherein the web is fastened to a second rotatable drum, the second rotatable drum feeding out the web to the first rotatable drum during image transfer and effective to take up the web prior to image transfer.

8. The apparatus according to claim 7 wherein the web passes about at least one set of guide rollers between the first rotatable drum and the second rotatable drum.

9. The apparatus according to claim 7 wherein the web receives a toned image from a master by being brought into proximity with the master by the transfer means at discrete points of transfer as the transfer means traverses the web.

10. The apparatus according to claim 9 wherein the web transfers a toned image from the first surface to a receiving surface by being brought into proximity with the receiving surface by the transfer means at discrete points of transfer as the transfer means traverses the web.

11. The apparatus according to claim 7 wherein the web transfers a toned image thereon by being brought into contact with the receiving surface as the second drum rewinds the web.

12. The apparatus according to claim 10 wherein the web is heated by heating means prior to being brought into contact with the receiving surface.

13. The apparatus according to claim 12 wherein the transferred image is fused to the receiving surface during transfer.

14. The apparatus according to claim 9 wherein the master is in the same horizontal plane as the transfer cables, the tensioning means and the opposing second end.

15. Apparatus in an image transfer device for tensioning a web to preserve dimensional integrity in a transferred image that is transferred from the web to a final receiving surface, comprising in combination:

(a) a web adapted to receive a toned image, the web extending between a first point and a second point on the image transfer device, the web further having two opposing lateral sides;

(b) transfer means movable along the web between the first point and the second point to transfer a toned image from a first surface to the web or from the web to the receiving surface;

(c) tensioning means connected on one end to the web at the first point and connected to the image transfer device at an opposing second end, the tensioning means being cooperative with the transfer means and in the same horizontal plane as the transfer means while the transfer means moves between the first point and the second point during transfer effective to tension the web and preserve the dimensional integrity of the transferred image;

(d) a first rotatable drum connected to the web at the first point effective to keep the web in tension and take up slack in the web;

(e) a second rotatable drum connected to the web effective to feed out the web to the first rotatable drum during image transfer and to take up the web prior to image transfer; and (f) means for connecting and disconnecting the tensioning means to disconnect the tensioning means in tension from the web to enable the web to be played out and taken up while maintaining the web in tension by counterrotational movement of the first rotatable drum and the second rotatable drum.

16. The apparatus according to claim 15 wherein the tensioning means further comprises a tensioning cable corresponding with each lateral side of the web.

17. The apparatus according to claim 16, wherein the web receives a toned image from a master by being brought into proximity with the master by the transfer means at discrete points of transfer as the transfer as the transfer means traverses the web.

18. The apparatus according to claim 16 wherein the tensioning cable and the web are connected to the first rotatable drum and the first point such that a sum of the distances from the first point to the transfer means and from the transfer means to the second point is always the same at each discrete transfer point as the transfer means traverses the web during transfer of the toned image to the web.

19. The apparatus according to claim 16 wherein the master is in the same horizontal plane as the transfer means, the tensioning cables and the opposing second end.

* * * * *

UNITED STATES PATENT AND TRADEMARK OFFICE

CERTIFICATE OF CORRECTION

PATENT NO. : 5,142,338

DATED : August 25, 1992

INVENTOR(S) : Malinaric et al.

It is certified that error appears in the above-identified patent and that said Letters Patent is hereby corrected as shown below:

In column 9 at line 46, please delete "cables" and insert --means-- in its place and after "tensioning" and before "and", please delete "means" and insert --cables-- in its place.

In column 10, line 37, please delete "as the transfer" (second occurrence)

Signed and Sealed this

Twenty-first Day of September, 1993

Bruce Lehman

*Attest:*

BRUCE LEHMAN

*Attesting Officer*

*Commissioner of Patents and Trademarks*